US005709318A

United States Patent [19]

Oder

[11] Patent Number: 5,709,318

[45] Date of Patent: Jan. 20, 1998

[54] DISPENSING CLOSURE WITH INTEGRAL LOCKING SWITCH AND TAMPER EVIDENCY STRUCTURE

[75] Inventor: Reuben E. Oder, Hamme (Merchtem), Belgium

[73] Assignee: The Procter & Gamble Company, Cincinnati, Ohio

[21] Appl. No.: 594,743

[22] Filed: Jan. 31, 1996

[51] Int. Cl.[6] ..... B67D 5/32

[52] U.S. Cl. ..... 222/153.06; 222/153.14; 222/533; 222/536

[58] Field of Search ..... 222/153.06, 153.14, 222/533, 534, 536, 556

[56] References Cited

U.S. PATENT DOCUMENTS

| | | | |
|---|---|---|---|
| 3,651,992 | 3/1972 | Hazard | 222/153 |
| 4,129,226 | 12/1978 | Percival | 215/235 |
| 4,378,073 | 3/1983 | Luker | 215/237 |
| 4,460,100 | 7/1984 | Libit | 215/237 |
| 4,462,504 | 7/1984 | Roth et al. | 220/214 |
| 4,519,517 | 5/1985 | Walter | 215/253 |
| 4,610,371 | 9/1986 | Karkiewicz | 220/266 |
| 4,696,408 | 9/1987 | Dubach | 215/237 |
| 4,696,410 | 9/1987 | Kreiseder | 220/267 |
| 4,711,363 | 12/1987 | Marino | 220/266 |
| 4,711,372 | 12/1987 | Gach | 222/23 |
| 4,722,449 | 2/1988 | Dubach | 215/235 |
| 4,773,550 | 9/1988 | Ekkert | 215/206 |
| 4,775,065 | 10/1988 | Shastal | 215/235 |
| 4,776,501 | 10/1988 | Ostrowsky | 222/517 |
| 4,782,964 | 11/1988 | Poore et al. | 215/216 |
| 4,807,769 | 2/1989 | Gach | 215/235 |
| 4,838,460 | 6/1989 | Moore et al. | 222/153.14 X |
| 4,911,324 | 3/1990 | Dubach | 220/339 |
| 4,919,286 | 4/1990 | Agbay, Sr. | 215/235 |
| 4,941,580 | 7/1990 | Julian | 215/235 |
| 4,947,735 | 8/1990 | Guillemin | 98/2.06 |
| 4,948,003 | 8/1990 | Munoz | 215/237 |
| 4,974,735 | 12/1990 | Newell et al. | 215/253 |
| 5,038,957 | 8/1991 | Gross | 220/335 |
| 5,058,775 | 10/1991 | Gross et al. | 222/153 |
| 5,069,367 | 12/1991 | Salmon et al. | 222/153 |
| 5,094,361 | 3/1992 | Dubach | 222/81 |
| 5,096,077 | 3/1992 | Odet et al. | 215/211 |
| 5,105,959 | 4/1992 | Kinsley | 215/227 |
| 5,123,561 | 6/1992 | Gross | 220/254 |
| 5,133,470 | 7/1992 | Abrams et al. | 215/250 |
| 5,141,138 | 8/1992 | Odet et al. | 222/541 |
| 5,147,054 | 9/1992 | Pehr | 215/253 |
| 5,201,440 | 4/1993 | Gross | 222/153 |
| 5,205,424 | 4/1993 | Gasper | 215/210 |
| 5,207,783 | 5/1993 | Burton | 215/256 |
| 5,279,451 | 1/1994 | Mueller et al. | 222/534 X |
| 5,284,264 | 2/1994 | Gross | 215/237 |
| 5,335,802 | 8/1994 | Brach et al. | 215/235 |
| 5,356,018 | 10/1994 | Dubach | 215/237 |
| 5,386,918 | 2/1995 | Neveras et al. | 215/235 |
| 5,392,938 | 2/1995 | Dubach | 215/254 |
| 5,579,961 | 12/1996 | Zimmerman | 222/556 X |
| 5,622,284 | 4/1997 | Sawicki | 222/153.14 |

*Primary Examiner*—Joseph Kaufman
*Attorney, Agent, or Firm*—Michael J. D'Amelio

[57] ABSTRACT

Disclosed is a dispensing closure for product packaging, having a closure body that attaches to a container, and a toggle dispensing lid with an integral locking switch attached to the closure body. An integral frangible tab, which must be fractured before the closure can be used to dispense product, may be included for tamper evidence. The integral locking switch has at least two living hinges so that it may be moved between locked and unlocked positions, thereby permitting movement of the dispensing lid between closed and product dispensing positions.

16 Claims, 6 Drawing Sheets

DISPENSING CLOSURE WITH INTEGRAL LOCKING SWITCH AND TAMPER EVIDENCY STRUCTURE

TECHNICAL FIELD

This invention relates generally to containers for dispensing products. More particularly, this invention relates to an improved dispensing closure having an integral switch to prevent opening of the closure, and an integral tamper evidency feature.

BACKGROUND OF THE INVENTION

Assemblies for dispensing liquid or solid product (e.g., pills, hair shampoo, liquid soap, detergents, and the like) are known in the art. Typically in such arrangements, a dispensing lid, having a product dispensing position and a closed position, is pivotally attached to a closure body. The closure body, in turn, may have a threaded structure for engaging a mouth or similar neck finish disposed on a product storage container such that the storage chamber is in product communication with the dispensing lid.

While previously available dispensers may function well for the purposes for which they were designed, they have drawbacks. For example, during shipping, storage and handling, a dispensing lid my inadvertently be moved to the dispensing position allowing spillage or other undesirable escape of the product. Such spillage may make the product nonsaleable, soil the surrounding environment, and/or inconvenience further handling and use. In addition, some prior structures also allowed purposeful opening of the containers and contamination of the contents during shipping or storage without the knowledge of the end user. In these and other circumstances, it would be desirable to provide an improved dispenser having a locking mechanism to prevent inadvertent movement of the dispensing lid and a tamper evidence structure that are easy to use and manufacture and do not add significant cost to the container.

Some prior ideas for preventing movement of a dispensing lid to its dispensing position include U.S. Pat. No. 5,284,264 to Gross which discloses a lid having a separate slide lock assembly. The lock assembly engages an abutment surface when in the locked position thereby preventing rotation of the lid to its dispensing position. When the lock assembly is translated to its unlocked position, it will clear the abutment surface thus permitting the lid to be rotated to its dispensing position.

Another example is seen in U.S. Pat. No. 5,205,424 to Gaspar, which illustrates a child resistant cap and container assemblage having a lid with an internal locking means and a spring to bias the lid in the closed position. When the dispenser is upright, a ball bearing is in obstructive contact with the lid preventing its movement to the open position. If the dispenser is tipped at an angle, the ball bearing moves out of obstructive contact with the lid thereby permitting movement of the lid to its dispensing position. Another embodiment discloses a slidable rod which engages the lid thereby preventing its rotation to the dispensing position.

Although these dispensers each provide a means for physically preventing the accidental movement of the lid to the dispensing position, they require the provision and assembly of a plurality of individual parts, resulting in somewhat complex and more costly packaging. Consequently, it would be desirable to provide a locking structure which is formed integrally with the lid and/or closure body, for simplicity and ease of manufacture, and which may initially function as a shipping lock and which thereafter may repeatably function as a travel lock. It would also be advantageous if such a structure were child-proof yet still easily manipulated by adults. In addition, a tamper evidence structure (e.g., an external visual seal and/or indicator) for indicating whether the lid had previously been moved to the dispensing position during shipping, storage or handling would be desirable. It would be further advantageous for simplicity and ease of manufacture if such a tamper evidence structure were similarly formed integrally with the lid and/or closure body. The present invention provides an improved dispensing closure which can accommodate designs having the above-described simplicity and multi-functional benefits and features, while being childproof, easy for adults to use, and without adding significant cost to the containers.

SUMMARY OF THE INVENTION

A dispensing closure is provided for dispensing a product from a container having a product storage chamber. The dispensing closure comprises a closure body, a dispensing lid having a lid top surface and an integral locking switch. The closure body has a top face with a downwardly depending skirt, a passageway, and an attachment structure for attaching the body to the container such that the container is in product communication with the passageway. The dispensing closure is also provided with a mounting structure, preferably a pivot, for movably attaching the dispensing lid such that the lid can be selectively moved between closed and dispensing positions. The dispensing lid has a discharge aperture disposed thereon such that, when the dispensing lid is in its dispensing position, the discharge aperture is in product communication with the passageway of the closure body.

The dispensing closure is also preferably provided with an integrally formed locking switch having a predetermined locked position with a stable first shape wherein the lid is in obstructive contact with an obstruction such that it is prevented from being moved to its dispensing position. The locking switch also has a predetermined unlocked position with a stable second shape wherein the lid is substantially clear of the obstruction such that it can be moved to its dispensing position. The obstruction may comprise a fib adjacent the skirt or a bottom edge of a cutout portion of the skirt. The rib may be further provided with a detent for preventing inadvertent movement of the locking switch.

In a preferred arrangement, the locking switch has a first living hinge and a second living hinge both of which are integrally formed with the dispensing lid or the closure body. Preferably disposed between the living hinges is a flexible member. In a more preferred arrangement, the locking switch comprises a third living hinge, a first switch member and a second switch member. The first switch member is disposed between and integral with the first and third living hinges while the second switch member is disposed between and integral with the second and third living hinges.

Finally, the locking switch and/or closure body can be provided with an integral frangible tab for tamper evidency. The frangible tab may be disposed between an extension and the lid surface or between a pair of wing members.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE PREFERRED EMBODIMENTS

Figure 1:
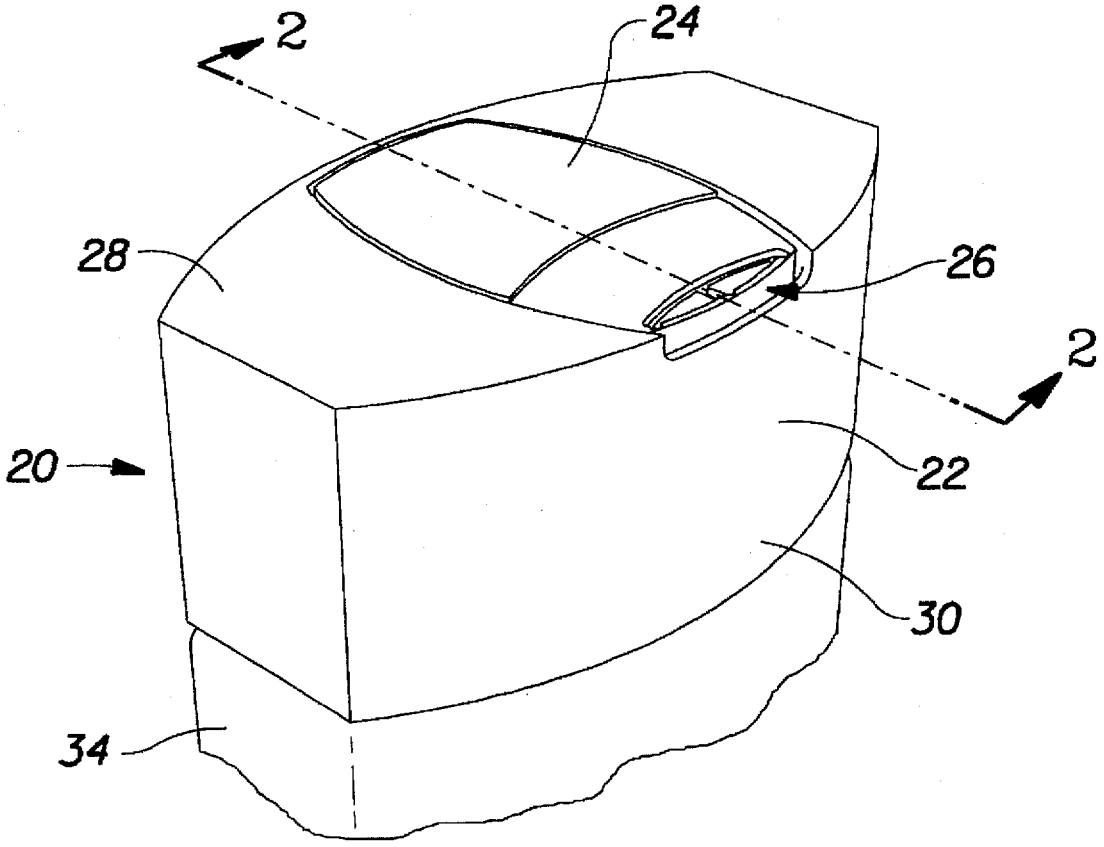
FIG. 1 is a perspective view of a dispensing closure made in accordance with the present invention.

Reference will now be made in detail to the present preferred embodiments of the invention, examples of which are illustrated in the accompanying drawings wherein like numerals indicate the same elements throughout the views. FIG. I is a perspective view of a dispensing closure 20 made in accordance with the present invention, comprising a closure body 22 and dispensing lid 24 having an integral locking switch 26, including at least two living hinges. The terms "integral" and 'integrally'; as used herein, shall generally mean a structure which is unitary with and formed as a part of another structure. The term "living hinge", as used herein, shall generally mean an integral structure having a reduced cross sectional area, when compared with surrounding structure, such that the structure is capable of rotational bending without significant degradation in structural integrity (i.e., capable of repeated bending without cracking or otherwise demonstrating signs of fatigue).

Closure body 22 preferably has a top face 28 and a skirt 30 which generally depends downwardly from the periphery of top face 28. Skirt 30 may comprise a single continuous curved or rounded section, or may be defined by the interconnection of a plurality of walls of various configurations (e.g., straight, convex, concave, partially circular, partially elliptical, or any combination thereof) to provide for a unique, pleasing appearance.

Figure 2:
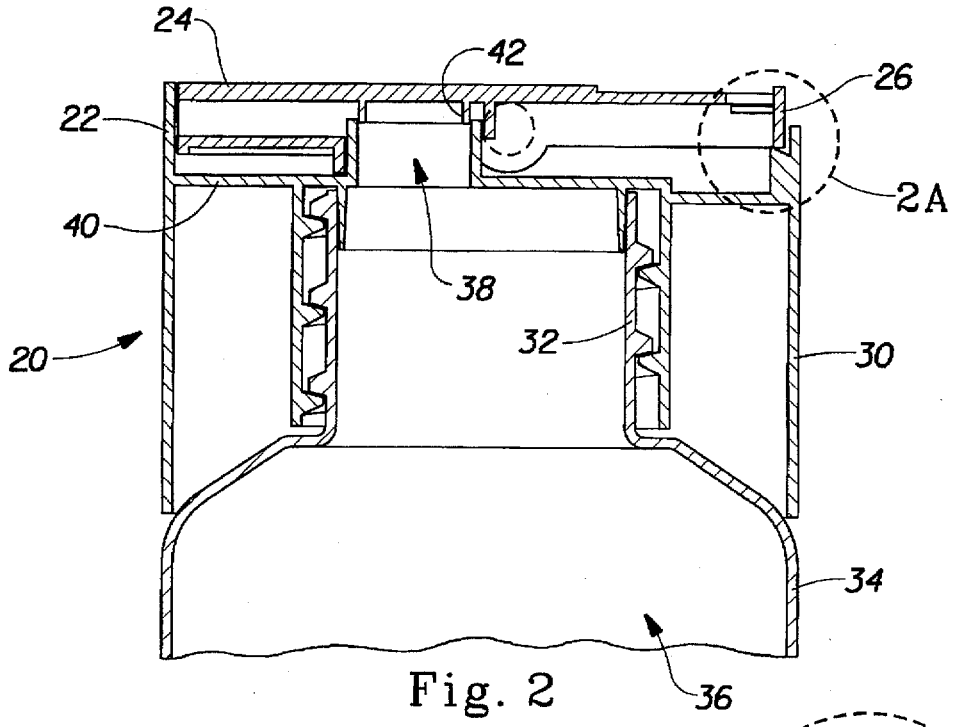
FIG. 2 is a cross sectional view of the dispensing closure of FIG. 1, taken along line 2—2 thereof, illustrating the dispensing lid in the closed position.
Figure 3:
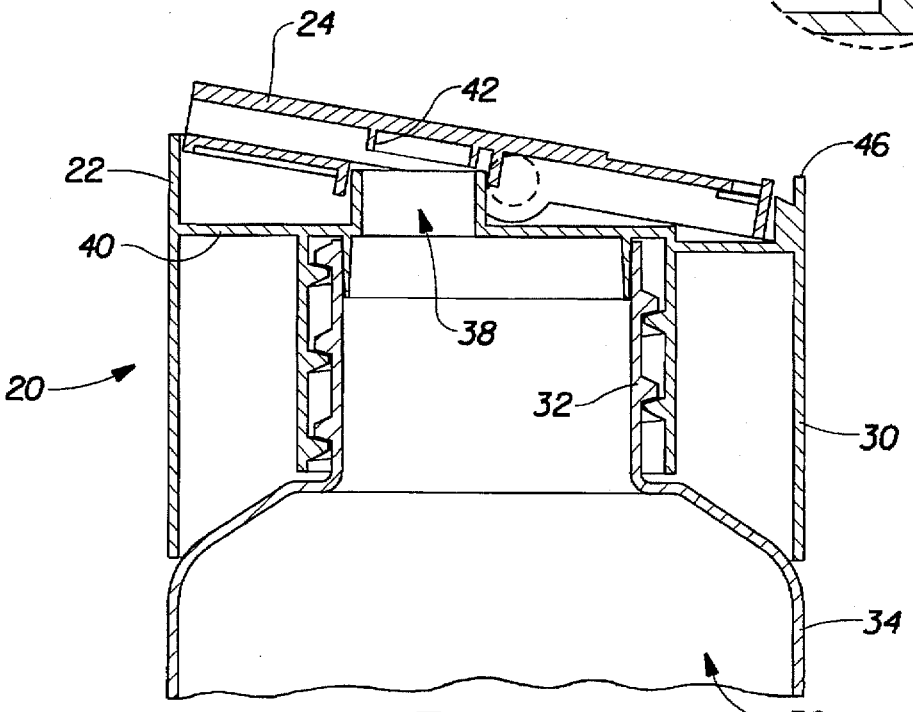
FIG. 3 is a cross sectional view of the dispensing closure of FIG. 1, taken along line 2—2 thereof, illustrating the dispensing lid in the dispensing position.

As best illustrated in FIGS. 2 and 3, dispensing closure 20 may be attached to an upwardly extending neck finish 32 of a bottle or similar container 34 having a product storage chamber 36. Neck finish 32 has an opening in product communication with storage chamber 36. Threads can be provided so that dispensing closure 20 may attach to container 34, although other attachment structures known in the art, such as snap fit arrangements, spin welding interfaces, or the like, are equally suitable for attaching the two pieces.

A dispensing opening 38 is provided through lower deck 40 in closure body 22, and is disposed such that dispensing opening 38 is placed in product communication with product storage chamber 36. Closure plug 42 extends downwardly from the inner portion of dispensing lid 24 such that it sealingly engages dispensing opening 38 when lid 24 is in its closed position (FIG. 2). When dispensing lid 24 is rotated to its open position (FIG. 3), plug 42 is raised clear of dispensing opening 38, thereby permitting dispensing of product.

Figure 4:
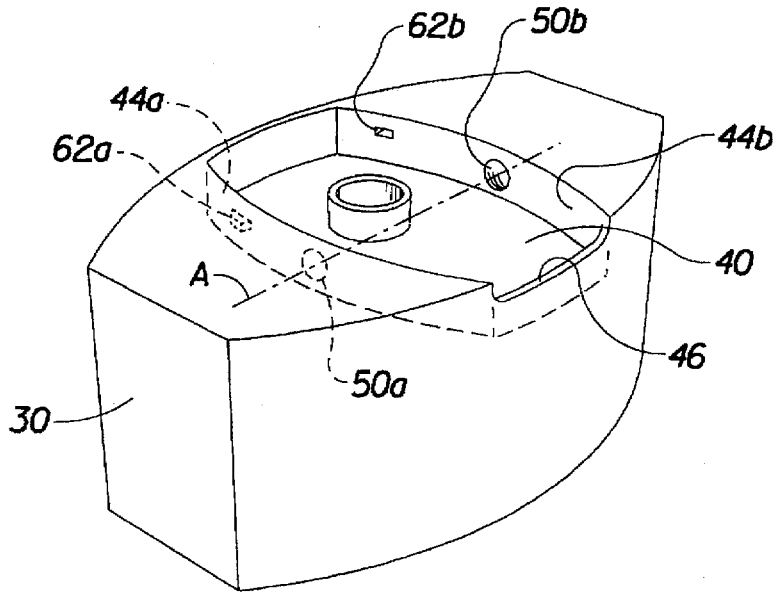
FIG. 4 is a perspective view of a closure body of a dispensing closure as illustrated in FIG. 1, shown without the dispensing lid for clarity.

Referring now to FIG. 4, a recessed cavity is defined, at least in part, by deck 40 and opposing deck walls **44*a* and 44*b*, which extend upwardly from and around deck 40, thereby providing a mounting location for dispensing lid 24. Although illustrated as being curved in shape, deck walls 44*a* and 44*b* may have any of a variety of configurations (e.g., straight, convex, concave, elliptical or any combination thereof). The front and rear of the cavity may be at least partially defined and enclosed by portions of skirt 30. A lowered portion of skirt 30 is preferably located on one side of the cavity to facilitate user access to locking switch 26, and is defined by lowered edge 46. In addition, lowered edge 46 and/or fib 48** (FIG. 2A) may define a locking switch obstruction for purposes that will be described in more detail hereinafter.

Figure 5:
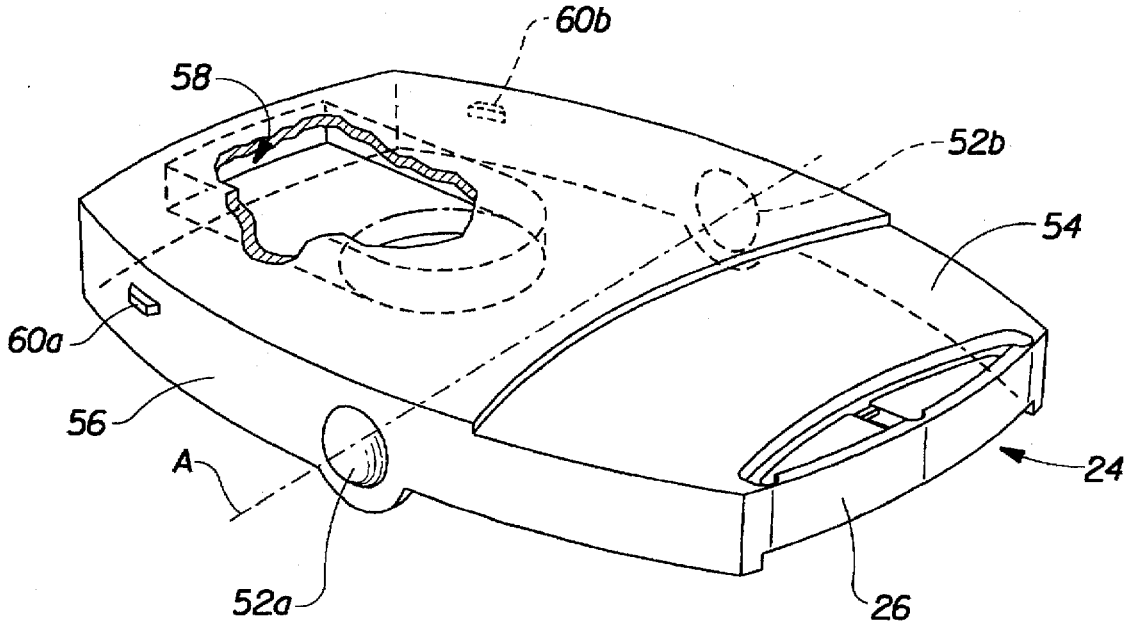
FIG. 5 is a perspective view of a dispensing lid of the closure of FIG. I, wherein the locking switch includes three living hinges and a frangible tab.

The cavity must be sized to accommodate dispensing lid 24, such that lid 24 may move (e.g., via pivoting) between a closed position (FIG. 2) and a dispensing position (FIG. 3). Deck walls **44*a* and 44*b* preferably include pivot recesses 50*a* and 50*b*, or similar mounting structures, which cooperate with knobs 52*a* and 52*b* (FIG. 5) on lid 24. When engaged, pivot recesses 50*a* and 50*b* and knobs 52*a* and 52*b* are pivotally aligned along an axis (e.g., axis A of FIG. 5) generally transverse to lid 24 and about which lid 24 may pivot. As best illustrated in FIG. 5, dispensing lid 24 has an integral locking switch 26, a lid top surface 54, and lid wall 56 which generally depends downwardly from the periphery of lid top surface 54. Dispensing lid 24 further includes a passage or discharge aperture 58 which communicates with opening 38 and allows the user to dispense product outwardly from dispensing closure 20 when in the open or dispensing position. Dispensing lid 24 can be provided with lid protrusions 60*a* and 60*b* (FIG. 5) which may engage lid depressions 62*a* and 62*b* (FIG. 4), thereby preventing inadvertent opening of lid 24 to its dispensing position. Lid protrusions 60*a* and 60*b* provide only a slight engagement with lid depressions 62*a* and 62*b* that can easily be overcome by the force a user would exert to move dispensing lid 24** to the dispensing position.

Figure 2A:
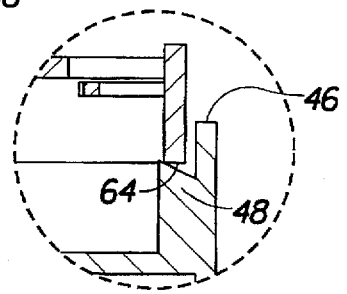
FIG. 2A is an enlarged partial cross sectional view of the dispensing closure of FIG. 2 taken about circle 2A thereof.

Locking switch 26 of the present invention may be provided in a variety of forms and structures, and can be formed as part of dispensing lid 24, as part of closure body 22, or as part of both. Preferably, locking switch 26 is in obstructive contact with an obstruction, such as rib 48 in FIG. 2A, in the locked position thereby preventing lid 24 from moving to its dispensing position without prior actuation of switch 26. For example, as shown in FIG. 2A, lowered edge 46 of locking switch 26 may be in obstructive contact with rib 48. As shown in FIG. 2A, edge 64 would have to dear rib 48 in order to move lid 24 to the dispensing position. Alternatively, locking switch 26 may be provided with a rearwardly extending structure (not shown) which is in obstructive contact with edge 46 of closure body 22 when locking switch 26 is in its locked position; in this case, rib 48 would be absent. When switch 26 is moved to its unlocked position, the obstruction would have to dear edge 46 so that lid 24 may be moved to the dispensing position.

Figure 6:
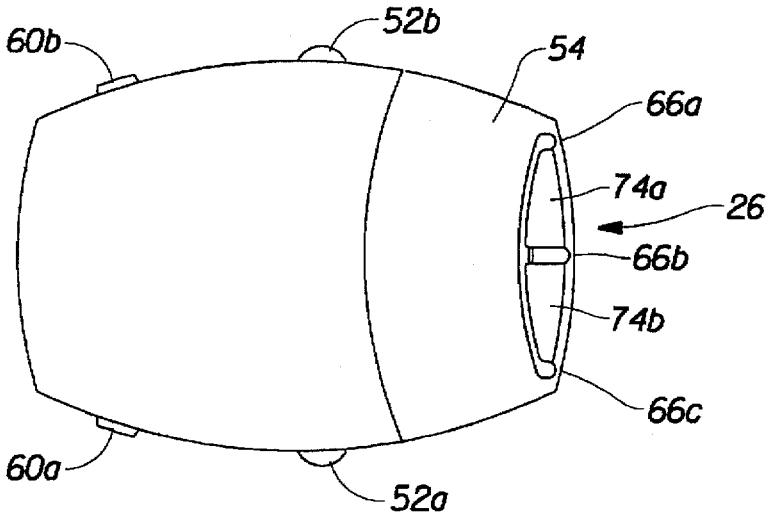
FIG. 6 is a top plan view of the dispensing lid of FIG. 5, illustrating the locking switch in its initial locked position.
Figure 7:
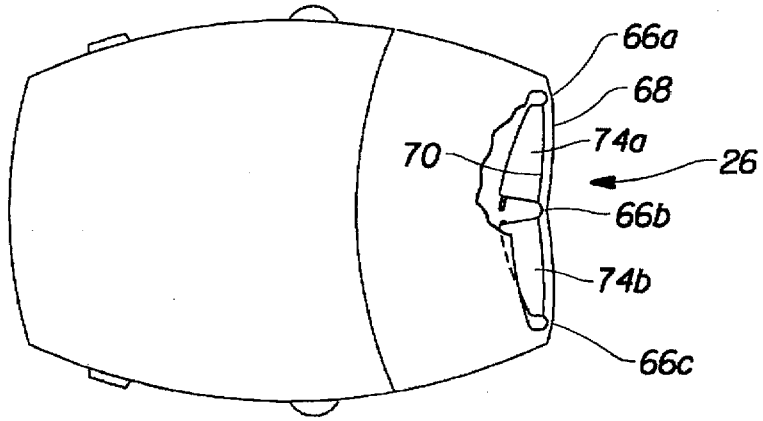
FIG. 7 is a top plan view of the dispensing lid of FIG. 5 illustrating the locking switch in its unlocked position.

As best seen in FIGS. 6 and 7, a preferred arrangement of locking switch 26 is shown having three living hinges **66*a*, 66*b*, and 66*c*. Locking switch 26 preferably has a stable first shape (FIG. 6), in which it is supplied, and a stable second shape (FIG. 7), in which it is purposefully put, corresponding to the locked and unlocked positions, respectively. The phrase "stable shape," as used herein, is intended to refer to a position of locking switch 26 which can be maintained without application of any external force. While it is believed that the action of bi-stable locking switch 26** will be understandable to those of ordinary skill in the art, for completeness and clarity, a general description of the hi-stable operation of the illustrated embodiments will be provided.

Figure 8:
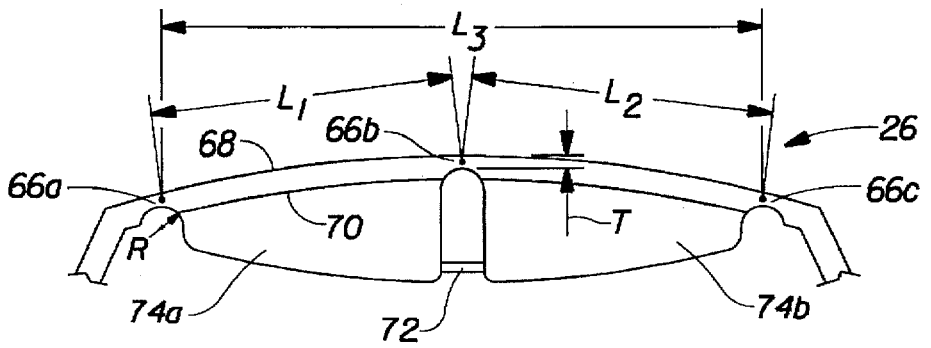
FIG. 8 is an enlarged plan view of the locking switch of the dispensing lid of FIG. 5.

As illustrated in FIG. 8, the living hinges are areas of reduced thickness "T" along switch 26. The portions of switch 26 between the hinges have effective lengths $L_1$ and $L_2$ as shown. Length $L_3$ is the approximate distance between living hinges **66*a* and 66*c*. The living hinges also have hinge radii "R". L1 plus L2 must equal a length greater than L3. This difference in length must not be so great that switch 26**, when moved from the locked to the unlocked position, will suffer permanent damage; however, the length difference must be great enough so that the switch will hold the unlocked position when the user releases applied force from it.

As the switch is pushed forward, and L1 and L2 line up in a straight line, switch 26 goes into compression. The natural tendency for the material at that point will be for it to want to spring back to a relief position, upon release of the user's applied force, that releases the compressive forces within. Before a certain point during actuation, that relief position will be it's original position (as shown in FIG. 8). Beyond that certain point during actuation, that relief position will be the position shown in FIG. 7. In the position of FIG. 7, the outside surface 68 of switch 26 will be in compression, and the inside surface 70 of switch 26 will be in tension, but the major compressive forces within the body of the switch will be relieved and this will allow the switch to hold its position. Locking switch 26 will retain this position until force is applied in the opposite direction to once again put the switch in the locked, or as supplied, position.

Figure 11:
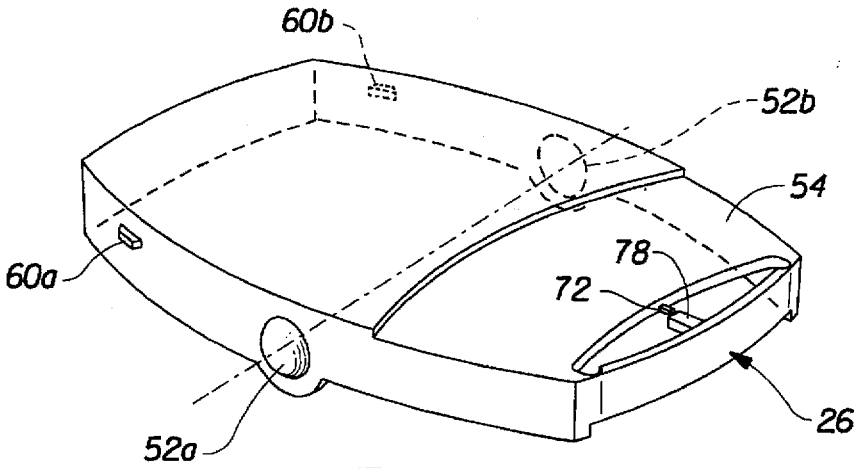
FIG. 11 is a perspective view of a dispensing lid of the present invention, wherein the locking switch is provided with two living hinges and a frangible tab.

In another preferred arrangement, locking switch 26 can be provided with an integral tamper evidence structure for alerting the user of dispensing closure 20 whether dispensing lid 24 may have been moved to the dispensing position during shipping, storage, or handling. Frangible tab 72 (FIG. 8) is preferably disposed between and integral with wing members **74*a* and 74*b* and has a location of reduced cross sectional area (or other stress attracting configurations such as perforations or the like) such that when force is first applied to locking switch 26, tab 72 will fracture thus permitting movement of locking switch 26 from a locked position to an unlocked position. Preferably, tab 72 fractures such that it does not interfere with the return movement of locking switch 26 to its locked position. As shown in FIG. 11, frangible tab 72 may also be integrally attached between locking switch 26 and surface 54 such that it may fracture in compression the first time the switch is pushed. Once tab 72 is breached, it provides a physical and visual indication of the fact that the tamper seal has been broken. Frangible tab 72 may also work in cooperation with other tamper evidence structures such as cellophane seals and the like. In addition, frangible tab 72** may be formed from a material whose color changes when subjected to strain or fracture, such as a dark pigmented plastic. Such a feature would advantageously aid in the tamper evidence function.

Figure 9:
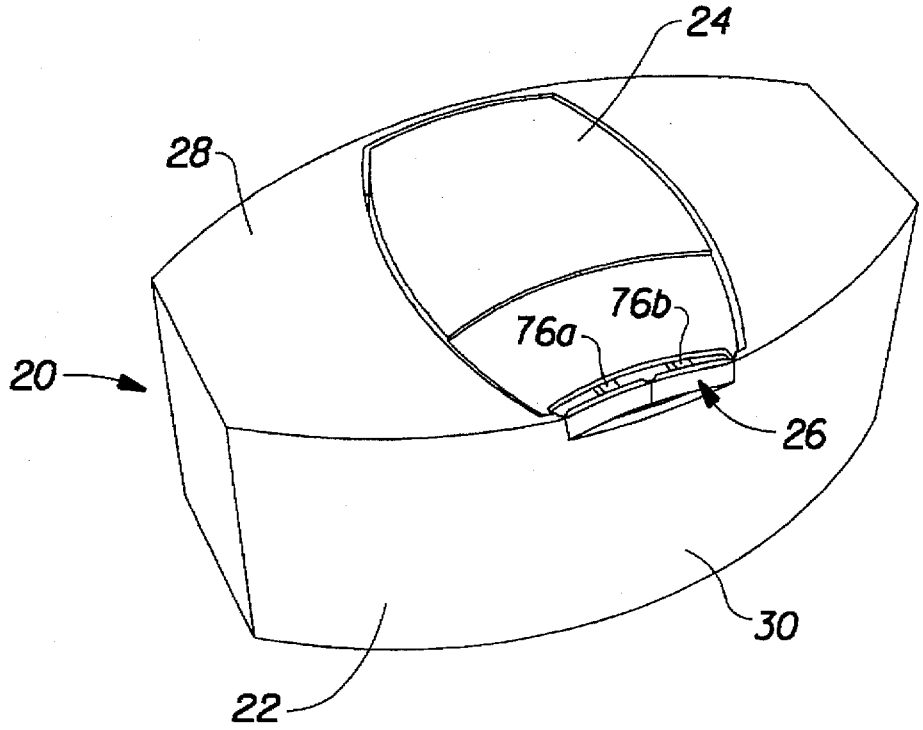
FIG. 9 is a perspective view of a dispensing closure made in accordance with the present invention, wherein the locking switch is integrally formed with the closure body and is shown in its locked position.
Figure 10:
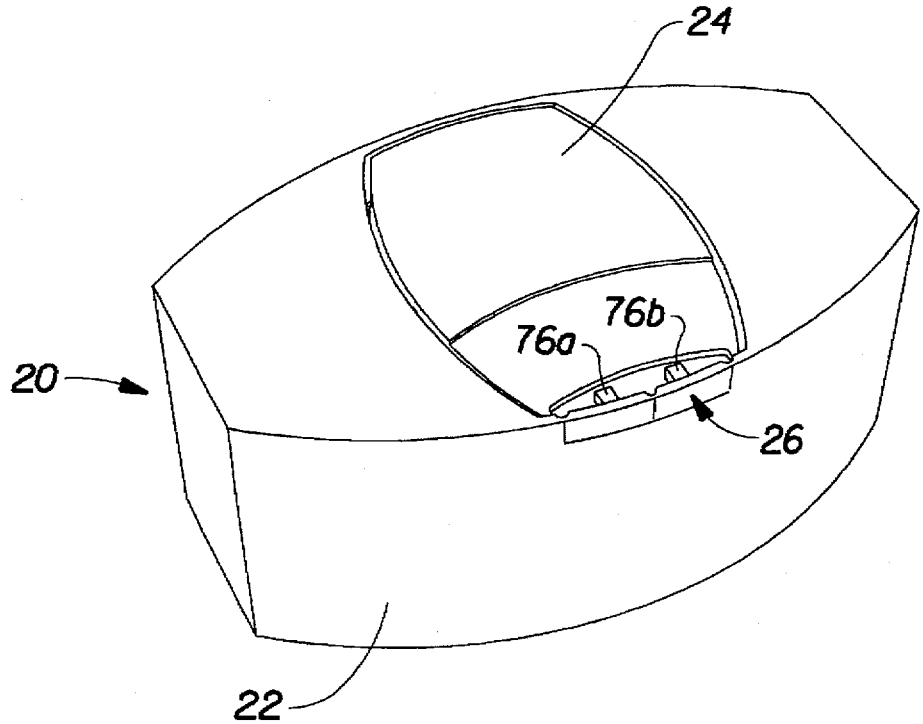
FIG. 10 is a perspective view of the dispensing closure of FIG. 9, wherein the locking switch is shown in its unlocked position.

As best illustrated in FIGS. 9 and 10, still another preferred embodiment can be provided wherein locking switch 26 is integrally formed with closure body 22 rather than dispensing lid 24. In this arrangement, switch 26 has an "as supplied" locked position with a stable first shape, as best shown in FIG. 9. Protrusions **76*a* and 76*b* act as the obstruction to moving the lid 24 to the dispensing position. As switch 26 is pulled outward, it will reach a point where it holds its unlocked position as described above, and as shown in FIG. 10. Protrusions 76*a* and 76*b* are clear of the inside surface of lid 24 when locking switch 26 is in the unlocked position (FIG. 10), such that dispensing lid 24** can now be rotated to its dispensing position. Tamper evidence may also be provided by a frangible tab similar to that described above.

Figure 12:
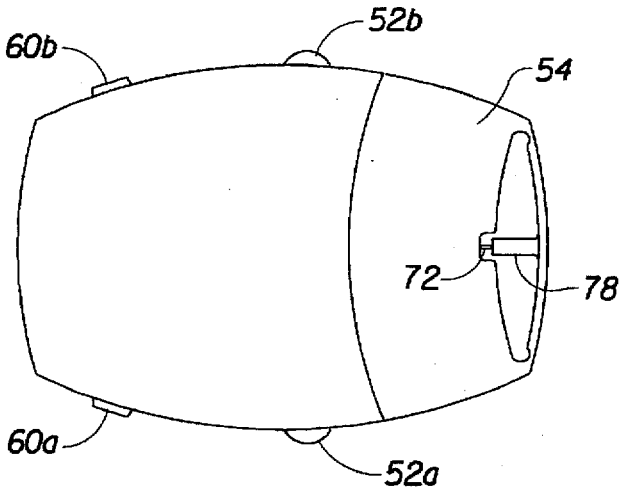
FIG. 12 is a top plan view of the dispensing lid of FIG. I 1, illustrating the locking switch in its initial locked position.
Figure 13:
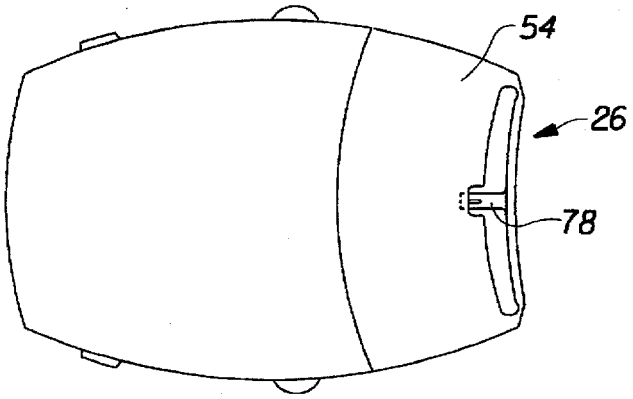
FIG. 13 is a top plan view of the dispensing lid of FIG. 11, illustrating the locking switch in its unlocked position.

As best illustrated in FIGS. 11 through 13, yet another preferred embodiment of the present invention can be provided wherein locking switch 26 includes only two living hinges. This works as described above, except that the switch body retains more flexibility without the wing structure shown in FIG. 8, and as such the switch 26 will retain the unlocked position without the need for a third living hinge.

As shown in FIGS. 11 through 13, frangible tab 72 may be integrally formed between lid top surface 54 and extension 78 such that switch 26 cannot be moved from the locked position without fracturing or otherwise rupturing frangible tab 72. Extension 78 is integrally molded with switch 26 and positioned such that it may pass without substantial interference either above or below lid top surface 54 when locking switch 26 is moved from a locked position to an unlocked position or vice versa. Frangible tab 72 is preferably formed integrally to both extension 78 and lid top surface 54 such that it will fracture when placed in compression, by a force applied to locking switch 26.

Preferably, closure body 22, dispensing lid 24 and locking switch 26 are formed from plastic or the like. More preferably, for economy and ease of manufacture, they may be manufactured by injection molding although other methods such as plastic welding, adhesive or mechanical connection of separately constructed parts may also be suitable. Locking switch 26 may also be used repeatedly as a travel lock so as to reduce the risk of inadvertent movement of lid 24 to its dispensing position during handling, traveling, etc.

The foregoing description of the preferred embodiments have been presented for purposes of illustration and description. It is not intended to be exhaustive or to limit the invention to the precise form disclosed. Modifications or variations are possible and contemplated in light of the above teachings by those skilled in the art, and the embodiments discussed were chosen and described in order to best illustrate the principles of the invention and its practical application, and indeed to thereby enable utilization of the invention in various embodiments and with various modifications as suited to the particular use contemplated. It is intended that the scope of the invention be defined by the claims appended hereto.

I claim:

1. A dispensing closure for selectively dispensing product from a container having a product storage chamber, said closure comprising:

a closure body having a top portion, a skirt downwardly depending from the top portion, a passageway extending through the top portion, and an attachment structure for attaching the closure body to the container and thereby putting the passageway in product communication with the product storage chamber of the container;

a dispensing lid having a discharge aperture in product communication with the passageway of the closure body, the dispensing lid being dispensingly attached to the closure body so as to provide for closed and dispensing positions of the dispensing lid; and a locking switch formed integrally to the dispensing closure, having a predetermined locked position wherein the dispensing lid is prevented from being moved to its dispensing position, and a predetermined unlocked position wherein the dispensing lid can be moved to its dispensing position; and wherein the locking switch further comprises at least two living hinges.

2. The dispensing closure of claim 1, wherein the locking switch is integrally formed with the dispensing lid.

3. The dispensing closure of claim 1, wherein the locking switch is integrally formed with the closure body.

4. The dispensing closure of claim 1 further comprising a frangible tab integrally formed with the dispensing lid so as to prevent actuation of the locking switch.

5. A dispensing closure for selectively dispensing product from a container having a product storage chamber, said closure comprising:

a closure body having a top portion, a skirt downwardly depending from the top portion, a passageway extending through the top portion, and an attachment structure for attaching the closure body to the container and thereby putting the passageway in product communication with the product storage chamber of the container;

a dispensing lid having a lid top surface and a discharge aperture in product communication with the passageway of the closure body, the dispensing lid being dispensingly attached to the closure body so as to provide for closed and dispensing positions of the dispensing lid;

a locking switch having at least two living hinges and formed integrally with the dispensing lid, the locking switch having a predetermined locked position wherein the dispensing lid is prevented from being moved to its dispensing position, and a predetermined unlocked position wherein the dispensing lid can be moved to its dispensing position; and a frangible tab integrally formed with the dispensing lid so as to prevent actuation of the locking switch, said frangible tab thereby preventing said dispensing lid from being moved to the dispensing position.

6. The dispensing closure of claim 5, wherein the dispensing lid is pivotally attached to the closure body.

7. The dispensing closure of claim 5, wherein the locking switch further comprises a flexible member disposed between the two living hinges.

8. The dispensing closure of claim 7, wherein the locking switch has a first stable shape when the locking switch is in the locked position.

9. The dispensing closure of claim 7 wherein the locking switch has a second stable shape when the locking switch is in the unlocked position.

10. The dispensing closure of claim 5, wherein the frangible tab is integral to the lid top surface.

11. The dispensing closure of claim 5, wherein the locking switch further comprises a third living hinge to facilitate flexibility.

12. A dispensing assembly for dispensing flowable fluid products, the assembly comprising:

a container having a product storage chamber for holding flowable fluid to be dispensed, and an outlet opening;

a closure body for engaging the container adjacent its outer opening, the closure body having a top portion, at least one downwardly extending peripheral wall depending from the top portion, a passageway extending through the top potion, an obstructive portion, and an attachment structure for attaching the closure body to the container and thereby putting the passageway in fluid communication with the product storage chamber of the container;

a dispensing lid pivotally attached to the closure body so that the dispensing lid is rotatable between a dispensing position and a closed position, the dispensing lid further having a lid top surface, a peripheral lid skirt depending downwardly from the lid top surface, and a discharge aperture in communication with the passageway;

a locking switch having first and second living hinges each formed integrally with the lid skirt, the locking switch being in obstructive contact with the obstructive portion of the closure body when in a locked position thereby preventing the dispensing lid from moving to the dispensing position, the locking switch being substantially dear of the obstructive portion when in an unlocked position thereby allowing the dispensing lid to be moved to the dispensing position, the locking switch having a first stable shape when in the locked position and a second stable shape when in the unlocked position; and a frangible tab formed integrally to the locking switch so as to prevent actuation of the locking switch, said frangible tab thereby preventing said dispensing lid from being moved to the dispensing position.

13. The dispensing closure of claim 12, wherein the locking switch further comprises a flexible member disposed between the first and second living hinges.

14. The dispensing closure of claim 12, wherein the obstructive portion comprises a tab of material fixed to the closure body.

15. The dispensing closure of claim 12, wherein the locking switch further comprises a third living hinge to facilitate flexibility.

16. The dispensing closure of claim 15, wherein the locking switch further comprises a pair of wing members having a frangible portion integrally formed between adjacent edges of the wing members, whereby the frangible portion must be fractured to provide for movement of the locking switch to the unlocked position.

* * * * *

UNITED STATES PATENT AND TRADEMARK OFFICE

CERTIFICATE OF CORRECTION

PATENT NO. : 5,709,318

DATED : January 20, 1998

INVENTOR(S) : Reuben E. Oder

It is certified that error appears in the above-identified patent and that said Letters Patent is hereby corrected as shown below:

*Column 8, line 17, "outer" should read --outlet--.*

*Column 8, line20, "potion" should read --portion--.*

*Column 8, line 38 "dear" should read --clear--.*

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*